United States Patent [19]

Roldness

[11] 4,324,189

[45] Apr. 13, 1982

[54] CAR END FOLDABLE DOORS LOCKING DEVICE

[75] Inventor: David J. Roldness, San Diego, Calif.

[73] Assignee: Pullman Incorporated, Chicago, Ill.

[21] Appl. No.: 130,881

[22] Filed: Mar. 17, 1980

[51] Int. Cl.[3] ..... B60P 3/08; B61D 17/00; E05C 19/12; E05D 15/26

[52] U.S. Cl. ..... 105/378; 160/187; 292/121; 292/128; 410/26

[58] Field of Search ..... 160/115, 152, 187, 188, 160/199, 206, 210, 211, 213; 292/121, 128, 219, 228; 410/26; 105/378, 395

[56] References Cited

U.S. PATENT DOCUMENTS

| | | | |
|---|---|---|---|
| 786,569 | 4/1905 | Jones | 160/213 |
| 848,853 | 4/1907 | Reed | 160/210 |
| 976,027 | 11/1910 | Beehler | 292/121 |
| 1,022,661 | 4/1912 | Duner | 160/187 |
| 1,603,301 | 10/1926 | Wood | 292/128 |
| 1,721,016 | 7/1929 | Gaskins | 292/128 X |
| 1,849,801 | 3/1932 | MacGregor | 160/211 |
| 3,107,722 | 10/1963 | Larsson | 160/188 |
| 3,416,836 | 12/1968 | Swanby | 160/115 X |
| 3,854,425 | 12/1974 | Allen | 105/378 X |
| 3,995,563 | 12/1976 | Blunden | 105/378 |
| 3,996,860 | 12/1976 | Ravani et al. | 105/378 X |
| 4,084,516 | 4/1978 | Ravani et al. | 410/26 |
| 4,164,189 | 8/1976 | Fritz et al. | 105/378 |

*Primary Examiner*—Joseph F. Peters, Jr.
*Assistant Examiner*—Howard Beltran
*Attorney, Agent, or Firm*—Richard J. Myers

[57] ABSTRACT

A locking mechanism disposed on one of the panels of foldable doors utilized in railway cars for transporting vehicles for automatically connecting the panels together when in a collapsed position.

12 Claims, 5 Drawing Figures

CAR END FOLDABLE DOORS LOCKING DEVICE

BACKGROUND OF THE INVENTION

1. Field of the Invention

The field of invention relates to folding door assemblies utilized in transportation vehicles, particularly to locking mechanisms for keeping the collapsed door panels together.

2. Description of Prior Art

U.S. Pat. No. 786,569 discloses a locking mechanism for folding doors having a combination of a jamb-locking lever and a door-coupling lever mounted upon one door of a pair of folding doors coacting with the studs mounted on a jamb and two doors.

U.S. Pat. Nos. 1,849,801 and 3,107,722 disclose a swinging hook engaging with a stud or a structural member of a hatch cover. A latching mechanism for holding the multi-leaf doors open having an H-shaped latching bar with one of the legs pivotally housed in a clamp and another leg being received in a T-shaped slot in a bracket was shown in U.S. Pat. No. 3,416,836.

U.S. Pat. No. 3,996,860 discloses a gravity hook engaged with a keeper welded on the crank to prevent folded door panels from swinging.

Also, gravity hooks engaging with a keeper plate or spring-loaded plunger catch for holding bi-fold doors in collapsed position were patented in U.S. Pat. No. 4,164,189.

The prior art fails to disclose a novel locking mechanism described in the subject invention.

SUMMARY OF THE INVENTION

The present invention of an improved locking device comprises a housing attached to the inside face of a first panel of a bi-fold door assembly and a spring-loaded lever disposed in the housing for disengaging the lock between collapsed panels. As soon as the outside face of the first panel contacts the same of the second panel the locking mechanism automatically couples both panels. A keeper end portion of the lever engaging with the keeper member on the outer panel may be manually disengaged by pivotal movement of the lever, the outer portion whereof is easily accessible when the panels are folded.

DESCRIPTION OF THE PREFERRED EMBODIMENT

Figure 5:
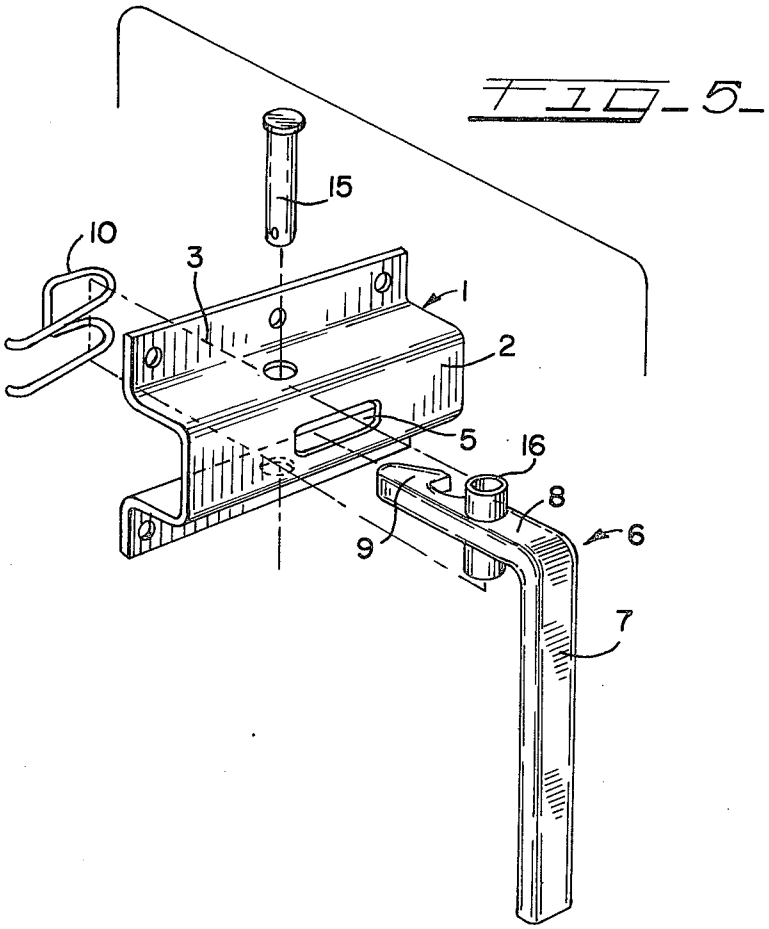
FIG. 5 is an exploded perspective view of a locking mechanism.
Figure 1:
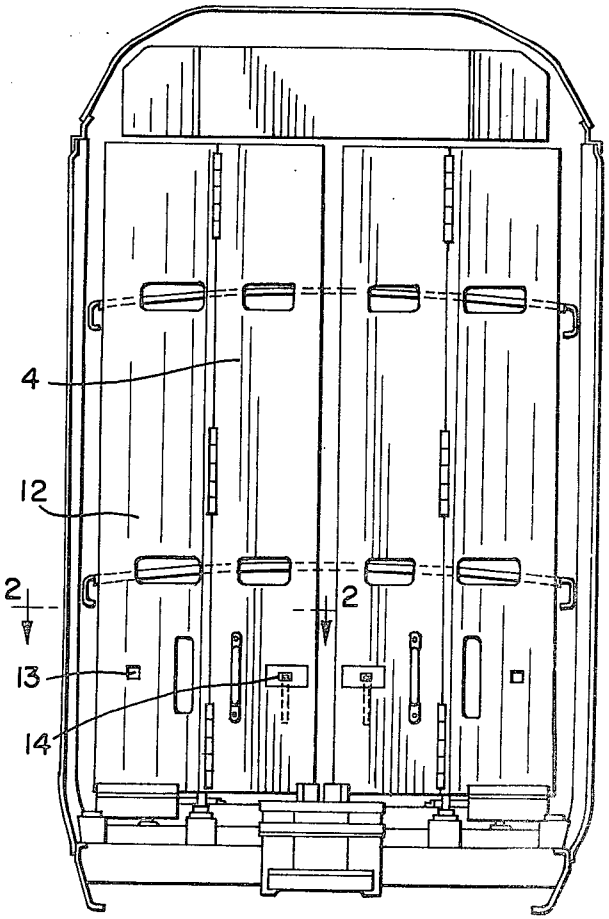
FIG. 1 is a rear elevational view showing the end of a railway car with doors in unfolded position.
Figures 2, 3, 4:
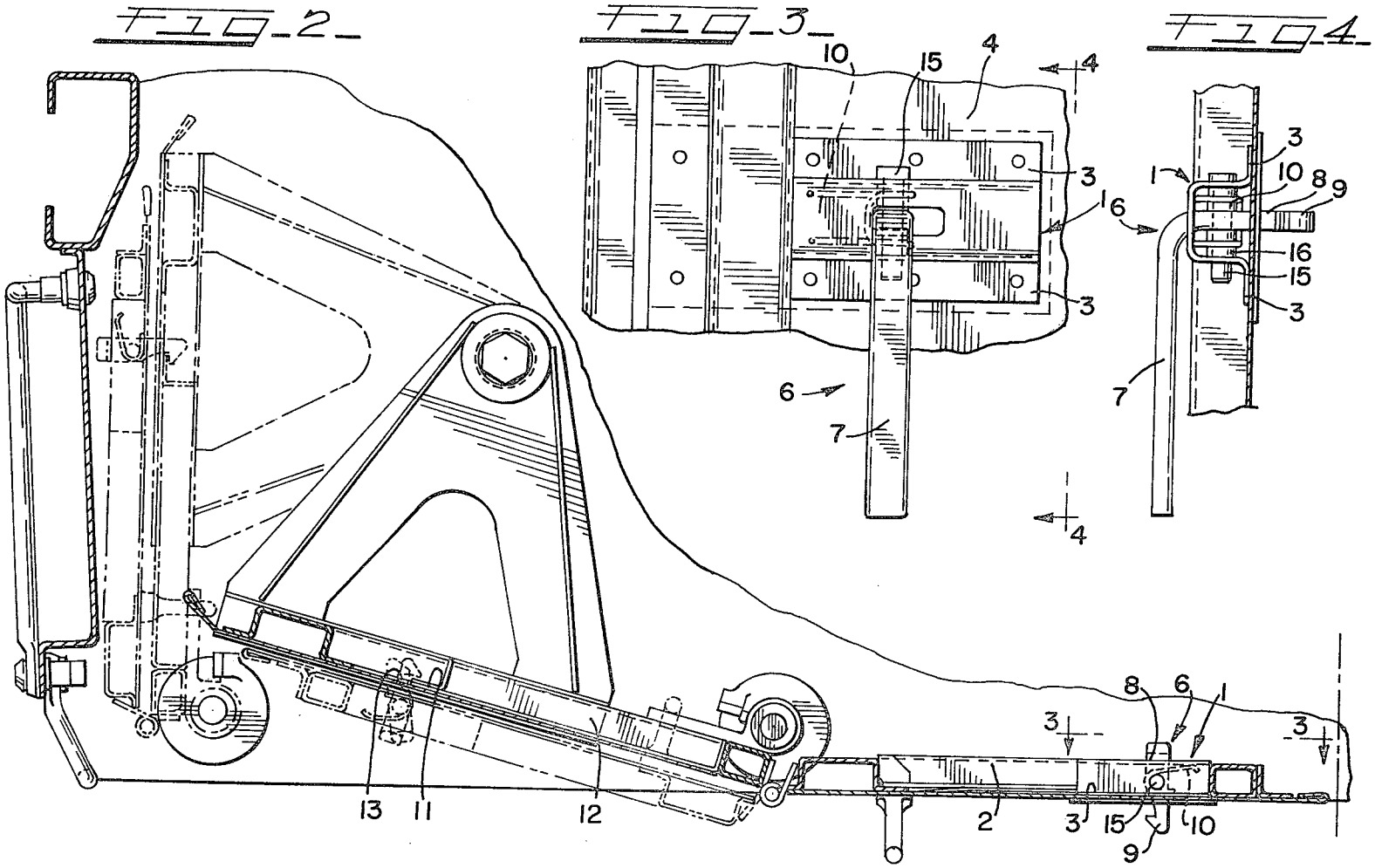
FIG. 2 is a cross-sectional view taken substantially along the lines 2—2 of FIG. 1 showing the partial opening of the folding door arrangement.
FIG. 3 is a side elevational view of a locking mechanism.
FIG. 4 is a cross-sectional view taken substantially along the lines 4—4 of FIG. 3.

A locking device for automatic coupling of the panels of bi-fold or foldable door assemblies utilized in transportation vehicles which comprises a hat-shaped housing 1 having an intermediate flange 2 and two oppositely extending flanges 3. The housing 1 is mechanically attached to the inside surface of a first panel 4. A central portion of the intermediate flange 2 has a center opening 5. An angle-shaped lever 6 has a vertical outer portion 7 and a horizontal portion 8 extending inwardly therefrom through said opening 5 inside the housing 1. The horizontal portion 8 has a keeper engaging end portion 9. A compression spring 10 is disposed in the housing 1. The spring 10 urges the end portion 9 to a locked position with a keeper member 11 disposed on the outer panel 12. The outer panel 12 has an opening 13 in registry with the latch engaging end portion 9 of the lever 6 to provide an access of the lever 6 to the keeper member 11 on the outer panel 12 when both panels, first and second, are folded together. The first panel 4 has an opening 14 in registry with the housing opening 5 and outer panel opening 13 to facilitate engagement of the keeper engaging end portion 9 with the keeper member 11 on the second panel 12. A cotter pin 15 projecting through the housing 1 is engageable with a bushing 16 attached to the horizontal portion 8 of the lever 6 to provide rotation of said lever horizontal portion 8 about its vertical axis on said housing 1. A locking device as described above facilitates automatic coupling of the panels of the doors utilized in transportation vehicles and allows easy disengagement by a slight pivotal movement of the lever which is located outside of the main area of activities at the end of the vehicle and is hidden inside the care when the folding panels of the door assembly are in the closed position. When the doors are collapsed and kept in the stored position the lever is located on the side parallel to the side walls of the vehicle free of any interference with the loading and unloading process at the end of the vehicle.

What is claimed is:

1. A door for use in railway cars comprising first and second panels foldably interconnected and being automatically coupleable together by a locking device, said locking device including a housing of hot shape, and having an intermediate flange and two oppositely extending flanges fastening said housing to said first door panel, a lever projecting inwardly through said housing and having inner an outer portions, biasing means comprising spring means inside said housing and urging said lever inner portion to locking position, means for pivoting said lever on said housing, and a keeper member connected to said second panel and coacting with said lever portion locking said first and second panels in a folded position.

2. A locking device in accordance with claim 1, and an opening in said intermediate flange through which said lever projects.

3. A locking device in accordance with claim 1, including an opening in said intermediate flange, and angle shaped lever having a vertical outer portion and a horizontal portion extending inwardly therefrom through said opening, said horizontal portion having a keeper engaging end portion.

4. A locking device in accordance with claim 1, and said second panel having an opening in registry with said lever inner portion to provide an access thereof to said keeper member on said second panel when said panels are folded together.

5. A locking device in accordance with claim 1, and second panel, housing and first panel have openings in registry with each other.

6. A locking device in accordance with claim 1, and second panel housing and first panel have openings in registry with each other, and said keeper member being disposed adjacent to said panel openings.

7. In a railway car having a body including side walls and a roof structure, said body having a loading end, and lower and upper cargo supporting horizontal decks adapted to be loaded with cargo through said loading end, the improvement comprising;

a door arrangement including a pair of door structure ends including first and second vertical door panels, first hinge means interconnecting said first and second door panels, second hinge means including a hinge bracket connected to said outer door panels, said hinge bracket having a hinge end portion spaced a substantial distance from an adjacent side wall and from the loading end of said body, pivot means connecting said hinge end portion to said upper and lower decks whereby said first and second vertical door panels may be folded together and hingedly moved to a position parallel to an adjacent side wall, said locking device including a housing of hat shape, and having an intermediate flange and two oppositely extending flanges fastening said housing to said first door panel, a lever movablely mounted on and projecting inwardly through said housing including a handle portion and a keeper engaging portion, said first panel having an opening and said keeper engaging portion projection through said opening, biasing means comprising spring means urging said keeper engaging portion to a locking position, and a keeper member connected to second panel coacting with said keeper engaging portion locking said first and second panels in a folded position.

8. A locking device in accordance with claim 7, and an opening in said intermediate flange through which said lever projects.

9. A locking device in accordance with claim 7, including an opening in said intermediate flange, and angle shaped lever having a vertical outer portion and a horizontal portion extending inwardly therefrom through said opening, said horizontal portion having a keeper engaging end portion.

10. A locking device in accordance with claim 7, and said second panel having an opening in registry with said lever inner portion to provide an access thereof to said keeper member on said second panel when said panels are folded together.

11. A locking device in accordance with claim 7, and second panel, housing and first panel having openings in registry with each other.

12. A locking device in accordance with claim 7, and second panel housing and first panel having openings in registry with each other, and said keeper member being disposed adjacent to said panel openings.

* * * * *